US006087907A

United States Patent [19]

Jain

[11] Patent Number: 6,087,907

[45] Date of Patent: Jul. 11, 2000

[54] TRANSVERSE ELECTRIC OR QUASI-TRANSVERSE ELECTRIC MODE TO WAVEGUIDE MODE TRANSFORMER

[75] Inventor: Nitin Jain, Nashua, N.H.

[73] Assignee: The Whitaker Corporation, Wilmington, Del.

[21] Appl. No.: 09/144,124

[22] Filed: Aug. 31, 1998

[51] Int. Cl.[7] ..... H01P 5/107

[52] U.S. Cl. ..... 333/26; 333/246

[58] Field of Search ..... 333/26

[56] References Cited

U.S. PATENT DOCUMENTS

| | | | |
|---|---|---|---|
| 2,825,876 | 3/1958 | Le Vine et al. | 333/34 |
| 2,829,348 | 4/1958 | Kostriza et al. | 333/26 |
| 3,969,691 | 7/1976 | Saul | 333/21 R |
| 4,052,683 | 10/1977 | van Heuven et al. | 333/26 X |
| 4,157,516 | 6/1979 | van de Grijp | 333/26 |
| 4,745,377 | 5/1988 | Stern et al. | 333/26 |
| 4,754,239 | 6/1988 | Sedivec | 333/26 |
| 4,891,614 | 1/1990 | De Ronde | 333/122 |
| 5,170,138 | 12/1992 | Roberts et al. | 333/24.1 |

FOREIGN PATENT DOCUMENTS

| | | | |
|---|---|---|---|
| 3207769 | 9/1983 | Germany | 333/26 |

OTHER PUBLICATIONS

Microwave Engineering Passive Circuits, Peter A. Rizzi, Southeastern Massachusetts University, 1988 by Prentice–Hall, Inc., p. 201, 5–4a Rectangular Waveguide.

1998 IEEE MTT–S International Microwave Symposium Digest, vol. One of Three, Jun. 7–12, 1988, pp. 257–260.

Foundations for microwave engineering, 1966 by McGraw–Hill, Inc., Circuit Theory for waveguiding systems, p. 183, 4.10 Excitation of waveguides.

Electronics Letters 29$^{th}$ Sep. 1977, vol. 13 No. 20.

*Primary Examiner*—Paul Gensler

[57] ABSTRACT

A transverse electric or quasi-transverse electric mode to rectangular waveguide mode transformer converts an electrical signal propagating in a transmission line from the TE or quasi-TEM transmission mode to a rectangular waveguide transmission mode for propagating in a waveguide. The transformer comprises a trace printed on a substrate, the substrate having first and second major surfaces and first, second, third, and fourth minor surfaces. The transformer is logically divided into a quasi-TEM mode portion, a conversion portion, and a waveguide mode portion. The quasi-TEM mode comprises a length of microstrip. The microstrip widens to a conversion trace in the conversion portion where there is one or more converting fins oriented perpendicularly to the direction of signal propagation. The conversion portion is adjacent the waveguide mode portion comprising metalized first and second major surfaces and third and fourth minor surfaces. The fins direct the quasi-TEM energy into waveguide mode energy in the substrate for propagation through the substrate.

38 Claims, 9 Drawing Sheets

TRANSVERSE ELECTRIC OR QUASI-TRANSVERSE ELECTRIC MODE TO WAVEGUIDE MODE TRANSFORMER

BACKGROUND

Many wireless communication systems use integrated circuits to generate and process transmitted and received communication signals. There exists, therefore, a need to convert the electrical signals generated in ICs and on printed circuit substrates to signals appropriate for transmission in air. There is also a parallel need to take signals received by antennas and convert them to signals that may be processed and interpreted by ICs and other circuitry. In the interest of miniaturization and maintaining communication signal integrity, it is desirable to integrate an IC with waveguide, so that waveguide signals may be launched and received directly to and from waveguide. There is a need, therefore, for a practical conversion from a signal travelling in a conductive metal strip or wire directly to a waveguide.

A known conversion is an E-field probe method in which a conductor of a coaxial cable or a coplanar line is positioned on an interior of a waveguide cavity. One end of the waveguide cavity is shorted. Signals in the probe produce an electric field and excite fields in the waveguide that are directly related to the signal. Accordingly, a certain amount of direct coupling can be achieved. Disadvantageously, the E-field probe method of transformation is bandwidth limited and requires complex assembly that is relatively intolerant to manufacturing tolerances due to the importance of the position of the probe in the cavity to achieve maximum coupling.

Another known conversion is disclosed in U.S. Pat. Nos. 2,825,876, 3,969,691, and 4,754,239 and is termed a "ridge transition". The ridge transition comprises a signal line supported by a dielectric substrate and positioned parallel to a ground plane on an opposite side of the dielectric in a microstrip configuration. An end of the microstrip abuts a waveguide cavity and a conducting ridge is positioned at the end of the microstrip and within the waveguide cavity. Although this method produces the desired conversion from microstrip to waveguide, the fabrication, positioning, alignment, and tolerancing of the conducting ridge renders the manufacture and assembly of the part complex and impractical for volume manufacturing.

Another known conversion is disclosed in MTT-S 1998 International Microwave Symposium Digest paper entitled "A Novel Coplanar Transmission Line to Rectangular Waveguide" by Simon, Werthen, and Wolff. The transformer comprises a microstrip line supported by a dielectric substrate. On an opposite side of the substrate, there are two printed conductive patches positioned in a waveguide cavity. The signal travelling in the microstrip induces a current in the patches that is coupled to the other patch. By proper choice of the patch separation constructive interference of the RF signal is achieved in the waveguide. Thereby, launching an electromagnetic wave in the waveguide. Disadvantageously, the structure disclosed has significant insertion loss at higher frequencies and a relatively narrow bandwidth of operation. Although the disclosed design has a simpler structure than the other prior art transformers, it is relatively sensitive to manufacturing tolerances and operating environment. In addition the transition also exhibits higher radiation and thereby reduced isolation and increased loss.

There remains a need, therefore, for a broadband manufacturable microstrip to waveguide transformer for high frequency ICs.

SUMMARY

It is an object of an embodiment according to the teachings of the present invention to provide a transformer that is simply manufactured and relatively insensitive to manufacturing tolerances of currently known manufacturing techniques.

It is another object of an embodiment according to the teachings of the present invention to provide a lower loss and higher bandwidth high frequency transformer than previously known in the prior art.

A signal line to waveguide transformer optimized for operation at an operating frequency comprises a substrate having first and second major surfaces and first, second, third, and fourth minor surfaces. The third and fourth minor surfaces have a conductive material and the second major surface have a conductive material thereon. The transformer further comprises a length of conductive trace for carrying an electrical signal and defining a direction of signal propagation which is disposed on the first major surface of the substrate. The conductive material on the second major surface is electrically connected to reference potential. At least one transmission line is disposed on the first major surface of the substrate, and is electrically connected to the conductive trace. The transmission line is oriented perpendicularly relative to the direction of signal propagation. There is a waveguide electrically coupled to the conductive trace It is an advantage of an embodiment according to the teachings of the present invention that a transformer design is acceptable for high volume manufacturing.

It is an advantage of an embodiment according to the teachings of the present invention that a transformer has relatively low insertion loss and broad operating bandwidth for high frequency applications.

It is an advantage of an embodiment according to the teachings of the present invention that a transformer has superior isolation than otherwise known in the prior art.

It is an advantage of an embodiment according to the teachings of the present invention that a transformer may be directly integrated into an IC package.

DETAILED DESCRIPTION

Figure 1:
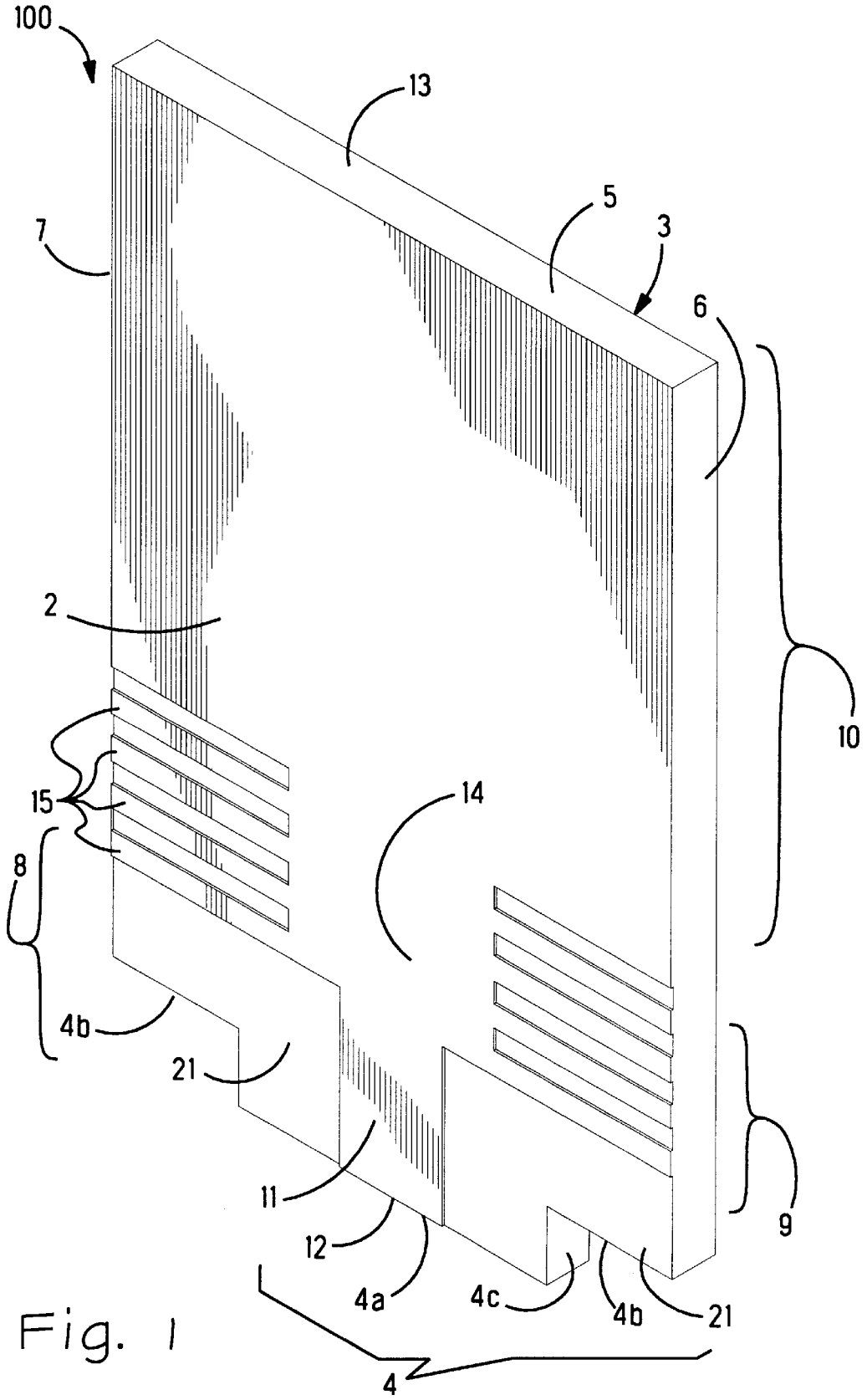
FIG. 1 is a perspective view of a microstrip mode to rectangular wave mode transformer looking toward a front side.
Figure 2:
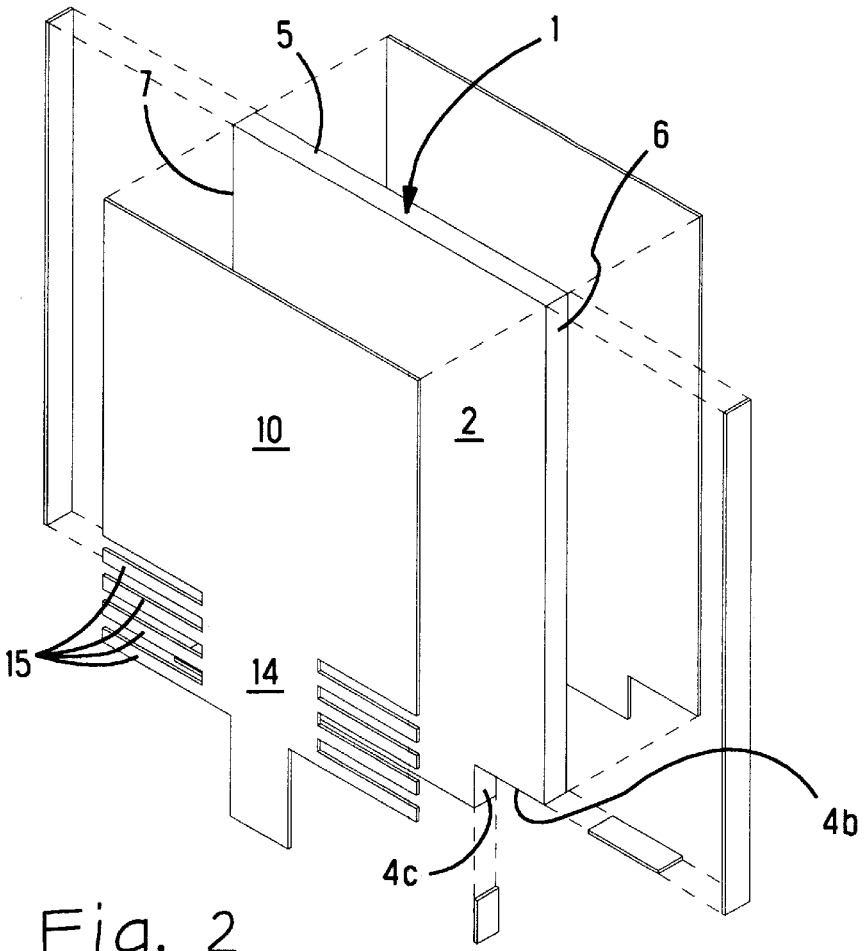
FIG. 2 is an exploded perspective view of the microstrip mode to rectangular wave mode transformer shown in FIG. 1 illustrating the substrate separate from the metalization.

With specific reference to FIGS. 1 and 2 of the drawings, there is shown an embodiment of a transformer 100 according to the teachings of the present invention. The transformer 100 as shown comprises a planar dielectric substrate 1 having first and second major surfaces 2,3 bounded by first, second, third and fourth minor surfaces 4,5,6,7. An appropriate material for the substrate is 125 micron Duroid having an effective dielectric constant of 2.2. Alternative substrate materials include: glass, Teflon®, and quartz although any substrate is appropriate. The transformer 100 is logically segregated into three adjacent portions: a quasi-TEM mode portion 8, a conversion portion 9, and a rectangular waveguide mode portion 10. In an embodiment as shown in FIGS. 1 and 2 of the drawings, an input signal line comprises a short length of conductive microstrip 11 printed onto the first major surface 2 of the substrate 1 extending from an edge of the substrate adjacent the first minor surface 4. The input signal line could alternatively comprise a coplanar transmission line or strip line, with or without an associated ground plane.

For purposes of the present disclosure, the input signal line is referred to as "the microstrip 11", although one of ordinary skill in the art can appreciate the modifications that may be made to the embodiments disclosed using coplanar transmission line, strip line, or other known transmission line equivalents. In a practical embodiment, the input signal line connects or couples external circuitry to the transformer 100. The short length of conductive microstrip 11, therefore, is an extension of a transmission line carrying a communications signal to or from the external circuitry.

The input signal line 11 extending onto the transformer substrate 1 can, therefore, be referred to as "Port 1" 12 of the transformer. The third and fourth 6,7 minor surfaces are perpendicular to minor surface 4*b* and the minor surfaces 6,7 and 4*b* and the second major surface 3 are fully plated with metal. By way of example, appropriate plating on Duroid is copper, however other conductive materials may also be used. The plating material on minor surfaces 4*b*, 4*c*, 6 and 7 provides an electrical short to the reference potential on the plated conductor present on second major surface 3. One of ordinary skill in the art will appreciate that such shorts can also be achieved using other means such as one or more via holes. In an embodiment using the via holes, the via holes are appropriately spaced so as to provide an equivalent of the short at the operating frequencies as provided by the continuous plating as shown in the drawings on minor surfaces 4,5,6 and 7. The second minor surface 5 is parallel to and opposite the first minor surface and in the embodiment shown in FIGS. 1 and 2 is not plated with metal. As will become apparent, the second minor surface 5 is a cross section of the rectangular waveguide cavity into which the rectangular TE10 mode is converted from the quasi-TEM mode incident in the microstrip 11 and can be referred to as "Port 2" 13. The second major surface 3 of the substrate is plated with metal and provides a ground plane for the microstrip 8 and provides a waveguide cavity boundary for the conversion portion 9 and the rectangular TE10 mode portion 10.

The quasi-TEM portion 8 of the transformer 100 is on an end of the substrate 1 and comprises the microstrip 11 printed onto the first major surface 2. In the disclosed embodiment, the transformer is optimized for 77 GHz central operating frequency. A one-quarter wavelength in the quasi-TEM mode for microstrip on Duroid having a dielectric constant of 2.2 is approximately 0.7 mm. The first minor surface 4 has an unplated area 4*a*, and is flanked on either side by plated areas 4*b* and 4*c*. The unplated area 4*a* is positioned concentric with the microstrip 11 and is longer than the width of the microstrip 11. The unplated or insulating area 4*a* extends on either side of the microstrip 11 to insulate it from the metalized and grounded plated portions 4*b* and 4*c* of the first minor surface 4. While it is not necessary to proper operation of the invention, the drawings show a nonlinear first minor surface 4 wherein the quasi-TEM mode portion 8 has two differing distances from the minor surfaces 4*c* and 6. An alternate embodiment of the quasi-TEM mode portion 8 comprises a linear first minor surface 4 plated at 4*b* and not plated at 4*a*. There are insulating lands 21 comprising areas of the first major side of the substrate 1 that are not plated. The insulating lands 21 bound the width of the microstrip in the quasi-TEM portion 8. The length of the quasi-TEM portion 8 from minor surface 4*b* to the adjacent conversion portion 9 is approximately one-quarter of a wavelength of the central operating frequency of the transformer 100, but can vary from between one quarter of a wavelength and less than half of a wavelength. The second major surface 3 of the substrate 1 is plated and grounded creating a ground plane parallel to the microstrip 11 in the quasi-TEM portion.

The microstrip 11 abruptly widens to a conductive conversion trace 14 in the conversion portion 9. A plurality of pairs of conductive converting fins 15 is printed onto the first major surface 2. Each fin 15 is disposed in perpendicular relation to the direction of electromagnetic propagation. Each fin 15 is positioned directly opposite another one of the fins 15 in the pair. In the embodiment illustrated in FIG. 1 of the drawings, each fin 15 is positioned co-linear with its pair fin 15 and on opposite sides of the converting trace 14. In this embodiment, there are four pairs of converting fins 15. Each fin 15 is equal to or greater than one-quarter wavelength of the operating frequency in length where the length of the fin is defined as beginning at the center of the conversion trace 14 and ending at the respective edges between the third or fourth minor surfaces 6,7 and the first major surface 2. In operation, the fins 15 electrically behave as transmission lines. At the operating frequency, the appropriate length of the transmission line electrically creates what appears to be an open circuit near, but away from the center of the conversion trace 14 by virtue of the more than one-quarter wavelength dimension. The transmission line, however, may also be emulated using a lumped element equivalent circuit instead of the fin 15, for example a parallel inductor and capacitor combination having appropriate values at the operating frequency. In alternate embodiments, it is not necessary that the fins 15 in each pair be co-linear with each other or that there be an equal number of fins 15 on either side of the conversion trace 14. Modifying these characteristics, however, will vary performance characteristics. These characteristics, therefore, may be used to optimize performance of the transformer for specific applications. In the present embodiment, the central operating frequency is 77 GHz. One quarter of a wavelength of microstrip in Duroid having a dielectric constant of 2.2 at a central operating frequency of 77 GHz is, therefore, approximately 0.70 mm (28 mils). Accordingly, a width of the conversion portion 9 using fins 15 on opposite sides of the conversion trace 14 is approximately equal to or greater than 1.4 mm (56 mils) total and has a TE10 mode cut-off frequency of 72.2 GHz. Alternate embodiments also include fewer pairs of fins 15 as well as additional pairs of fins 15 or transmission lines comprising the conversion portion 9 depending upon the desired electrical performance. Those of ordinary skill in the art will also appreciate that although a rectangular waveguide is described, the invention also applies to waveguides with cross sectional geometries that are not rectilinear.

The conductive conversion trace 14 and fins 15 are positioned adjacent the rectangular waveguide mode portion 10 of the transformer 100. The rectangular waveguide mode portion 10 comprises the dielectric substrate 1 having a rectangular cross section. The substrate 1 is plated with metal on all sides of the rectangular cross section creating a waveguide cavity in which the rectangular TE10 mode is able to propagate. For a printed circuit board the minor surfaces 6 and 7 could equivalently be achieved by plated through via holes. Since adjacent fins 15 or transmission lines are electrically close together, the currents flowing through the fins are approximately in phase. The currents through the fins induce magnetic and electric fields that interfere destructively in air, but interfere constructively in the dielectric. Most of the energy, therefore, is transferred into the substrate 1. The cross section of the substrate is bounded by grounded metalized surfaces creating a waveguide cavity through which the transferred energy in the form of a rectangular wave is able to propagate. Advantageously, the direction of propagation of the quasi-TEM mode in the microstrip 11 is the same direction of the propagation of the TE10 mode in the dielectric waveguide cavity of the substrate 1. The direction of signal propagation can be changed by suitable bends in the waveguide. For example, an alternate embodiment includes an opening in the second major surface adjacent the waveguide portion and plating on the second minor surface which operates to bend the wave propagating in waveguide 90 degrees. Additionally, slots, waveguide couplers, and other waveguide elements can be used to properly transmit the propagating signal into an air medium. It is also an advantage that the electric field is primarily contained within the cavity by grounded metalization around the quasi-TEM portion 8, the conversion portion 9, and the rectangular waveguide mode portion 10 of the transformer 100 providing isolation of the energy from without the substrate 1. Specific dimensions of an embodiment of a transformer according to the teachings of the present invention using a Duroid substrate with copper plating comprise a 2.1 mm (82 mil) dimension for the first and second minor surfaces 4,5 and a 2.87 mm (113 mil) dimension for the third and fourth minor sides 6,7. The length dimension of the third and fourth minor sides 6,7 may be varied substantially without affecting the operation of the transformer. The microstrip 11 in the quasi-TEM portion 8 is inset from the third and fourth minor edges 6,7 a distance of 0.85 mm (33.5 mils), resulting in a width dimension of 0.38 mm (15 mils) for the microstrip 11. The width dimension of each converting fin 15 is 0.05 mm (2 mils) with a fins spaced 0.05 mm (2 mils) apart from each other. Each fin 15 is 0.66 mm (26 mils) in length resulting in a width dimension of 0.76 mm (30 mils) for the converting trace 14. An embodiment of a transformer according to the teachings of the present invention using a glass substrate and gold metalization has a 1400 micron (55 mils) first and second side and a centered microstrip width of 250 microns (9.8 mils). The glass and gold transformer further has a 50 micron (2.0 mils) fin width and spacing between fins, and a 659 micron (26 mils) fin length. The substrate thickness for both Duroid and glass is 127 microns (5 mils).

Figure 3:
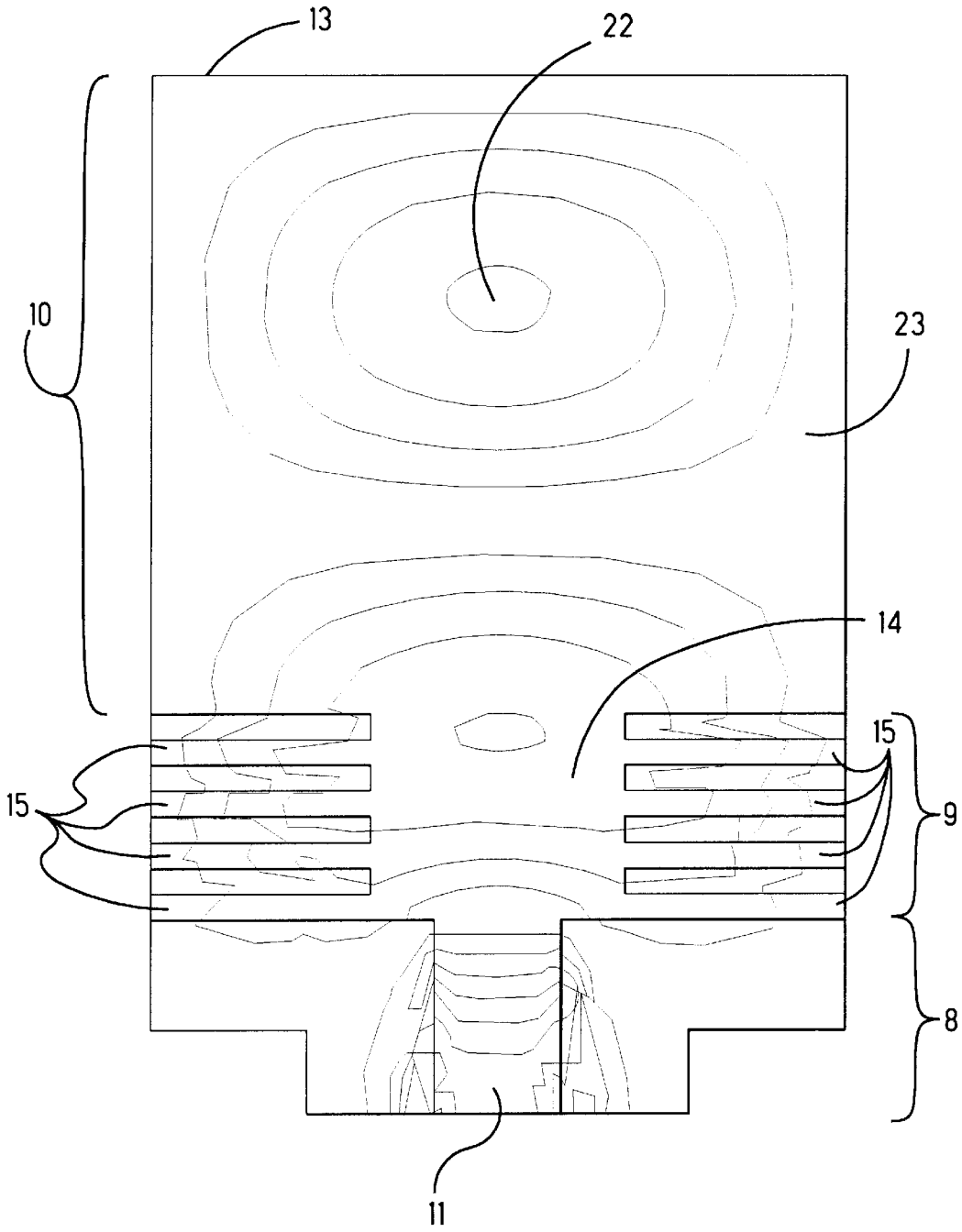
FIGS. 3 through 5 are three graphical representations at different moments in time showing the contours of electric fields induced in the transformer shown in FIGS. 1 and 2.
Figure 4:
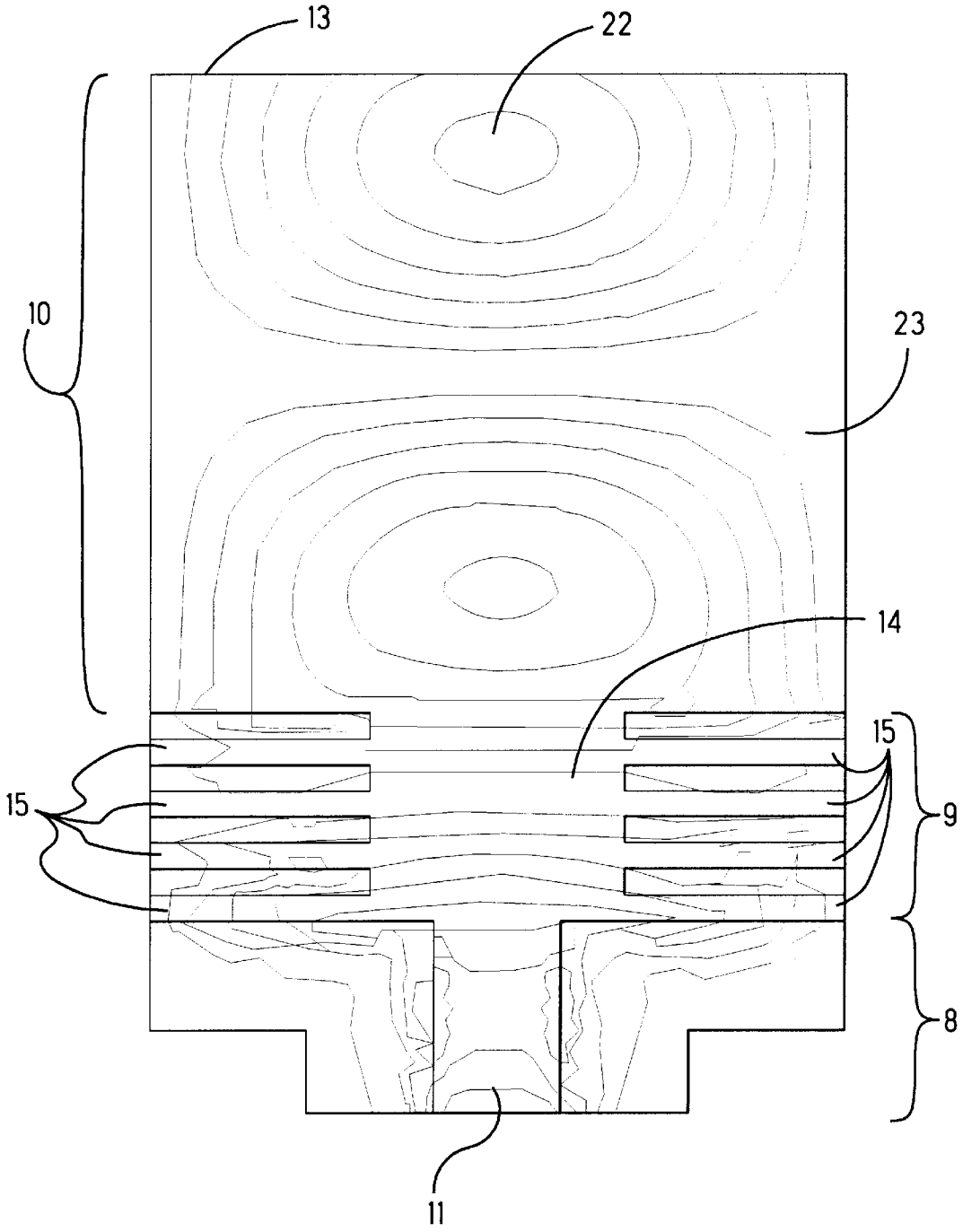
Figure 5:
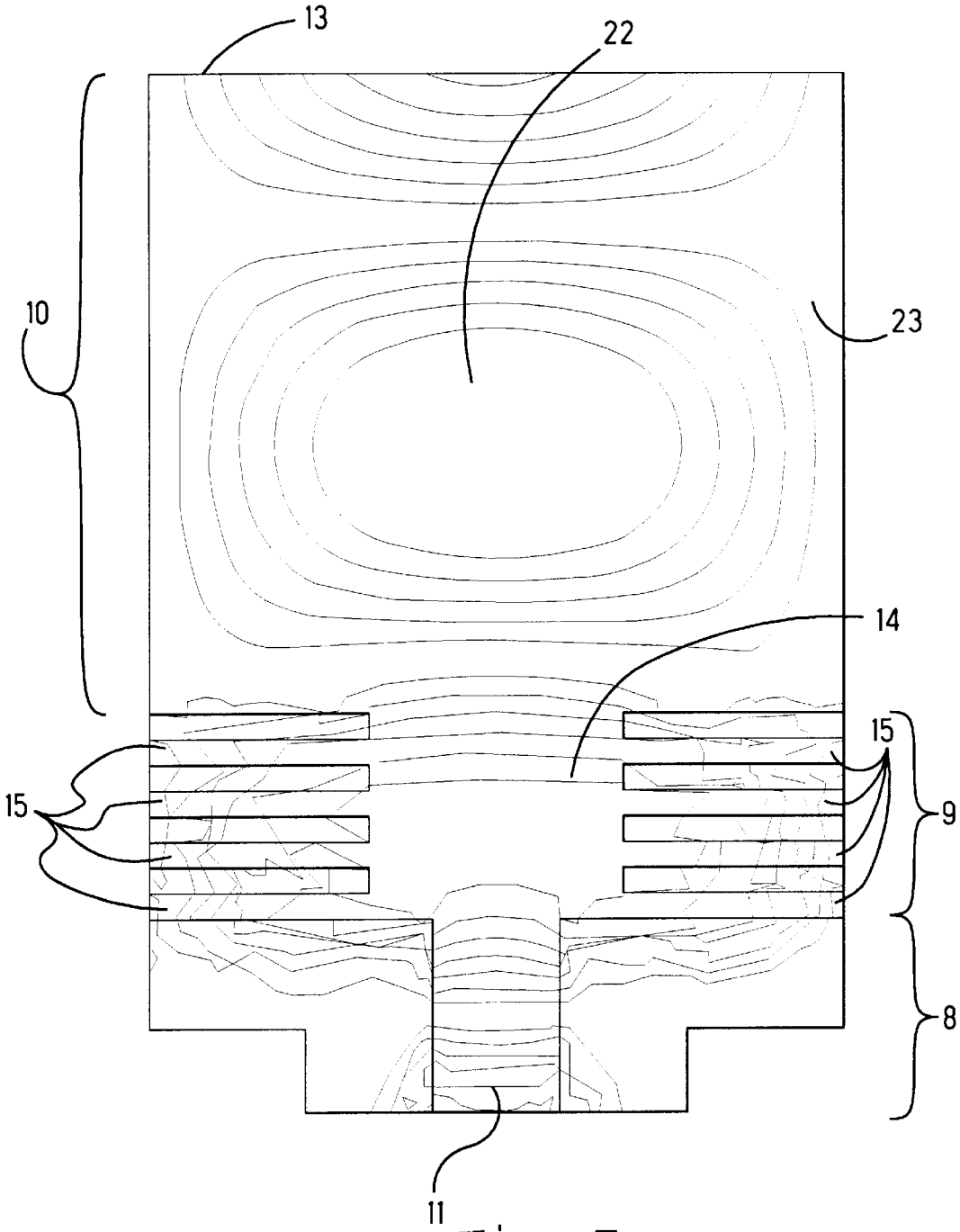
Figure 6:
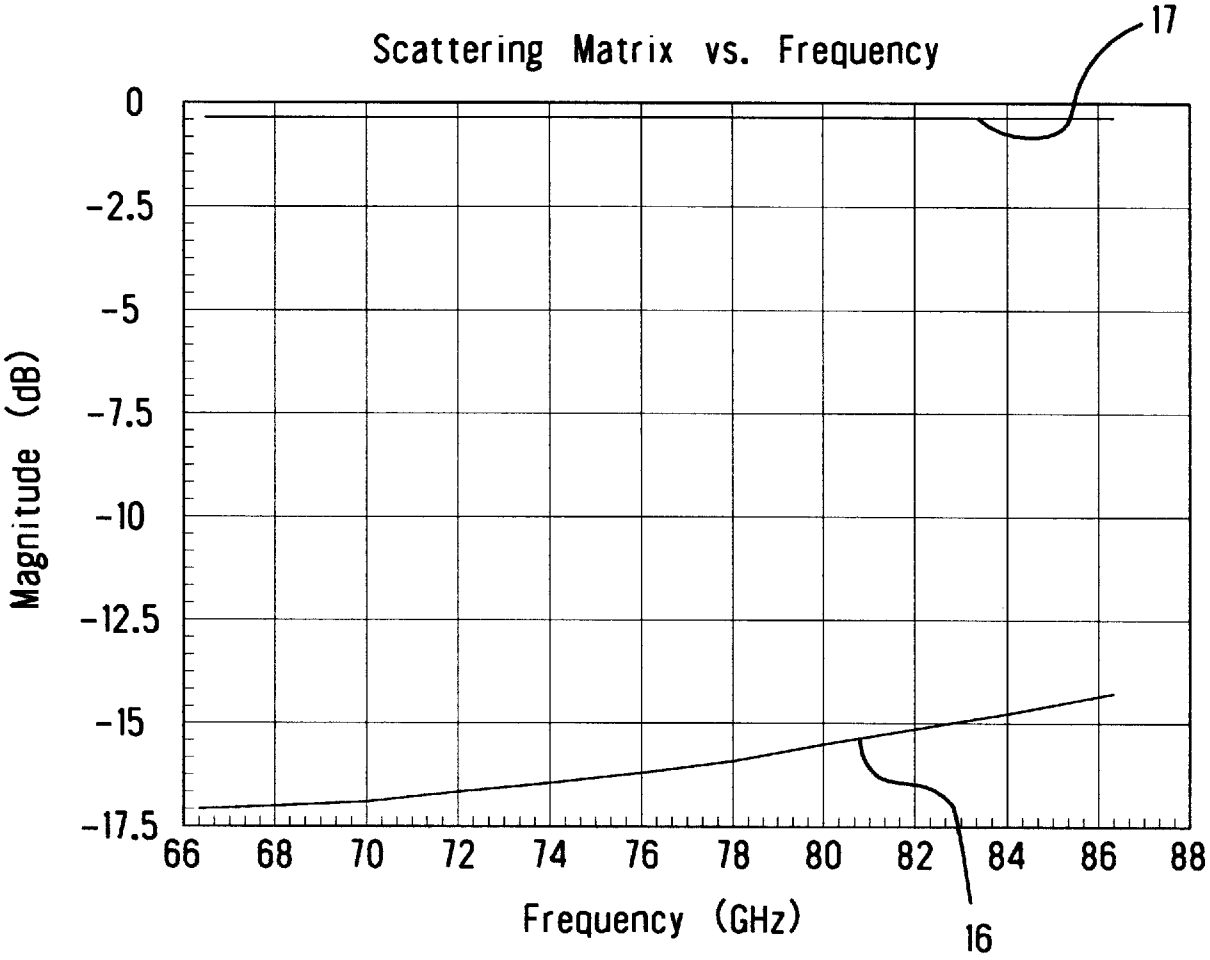
FIG. 6 is a graphical representation of scattering parameters versus frequency for the transformer shown in FIGS. 1 and 2.

With specific reference to FIGS. 3 through 5 of the drawings, there is shown a graphical representation of the electric fields propagating through the transformer illustrated in FIGS. 1 and 2 of the drawings. The figures represent three different points in time to illustrate the conversion of the quasi-TEM mode propagating in the microstrip 11 to the rectangular TE10 mode propagating in the waveguide portion. Specifically, FIG. 3 illustrates the 0 phase electric field, FIG. 4 and 5 illustrates the electric field at 60 degrees and 120 degrees respectively. Note that at 180 degree the field lines are of the same magnitude as shown for 0 degrees phase but the sign of the electric field is reversed. Since the magnitude is the same, FIG. 3 of the drawings also represents 180 degrees phase. Similarly 60 degree also represents 240 degree and 120 degree represents 300 degree. The solid lines represent contours showing areas where the electric field is in differing ranges. An area of maximum electric field is represented by the reference number 22 and an area of minimum electric field is represented by the reference number 23. The contours intermediate the maximum and minimum electric fields represent a smooth gradient between the areas of maximum and minimum electric field. With specific reference to FIG. 6 of the drawings, there is shown a graphical representation of scattering parameters S11 referenced as 16, representing return loss, and S21 referenced as 17, representing insertion loss for the transformer 100. As one of ordinary skill can appreciate, the insertion loss is very low over a broad range of frequencies near the 77 GHz operating frequency. In addition, the return loss parameter is also quite acceptable at the frequencies of interest. Advantageously, the transformer described utilizes conventional printing technology, and is therefore, appropriate for high volume manufacturing at a reasonable cost. The design is also tolerant of conventional manufacturing tolerances. In addition, the transformer exhibits low loss over a broad band and exhibits good isolation.

Figure 7:
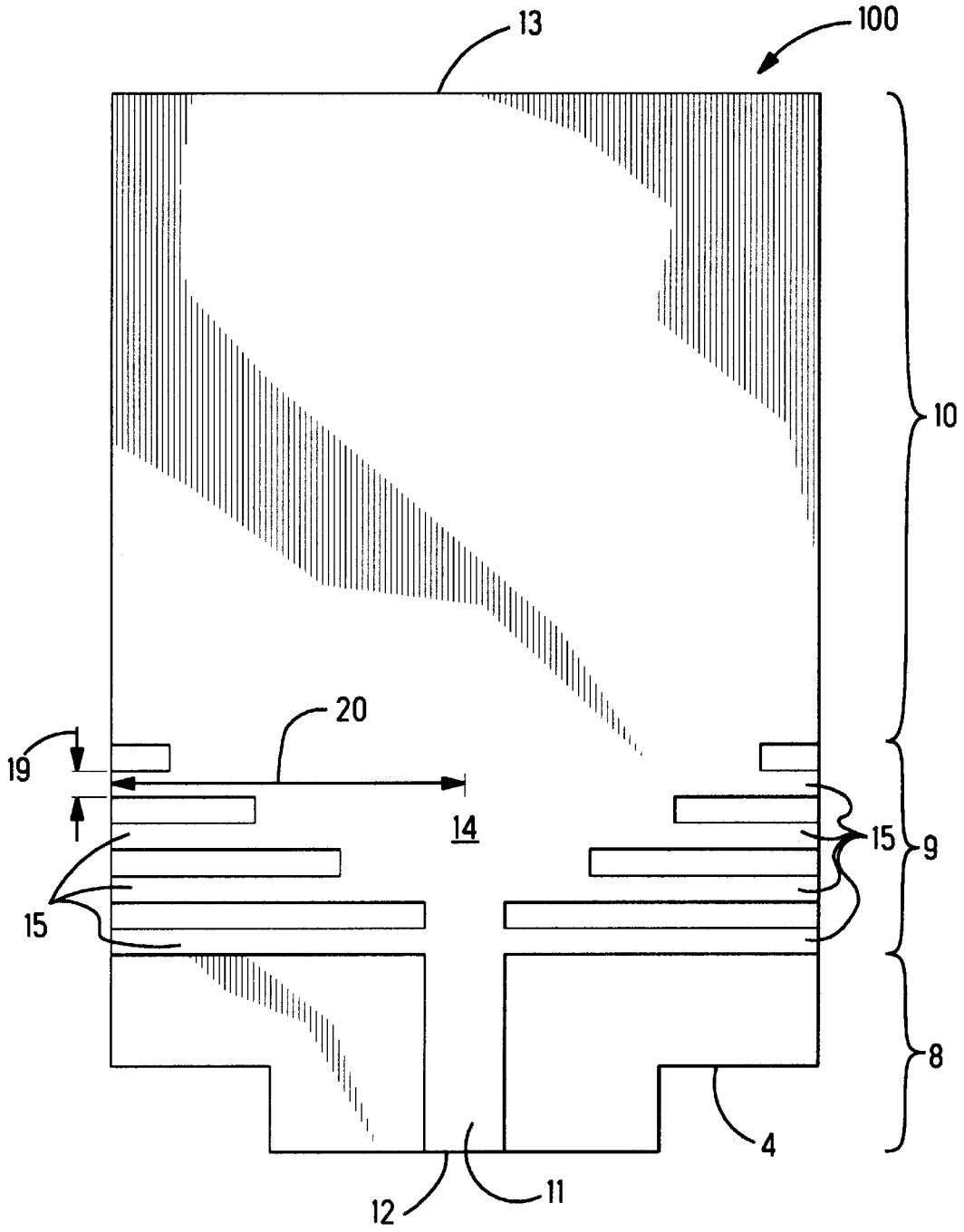
FIG. 7 is a plan view of an alternate embodiment of a microstrip mode to rectangular wave mode transformer.

With specific reference to FIG. 7, there is shown a plan view of a first major surface 2 of an alternate embodiment according to the teachings of the present invention in which there are four pairs of fins 15 comprising the conversion portion 9. The second major surface 3 looks identical to that shown in FIG. 2 of the drawings. All fins have a similar width dimension 19, and each fin 15 in a single pair of fins 15 has a same length dimension 20. The length of each fin 15 in the pair of fins 15 closest to the quasi-TEM mode portion 8 is longer than the other three pairs of fins 15. The length of the fins 15 in each pair tapers from longest to shortest in the conversion portion from the quasi-TEM mode portion 8 to the waveguide mode portion 10. In the embodiment shown, the width of all of the fins 15 is the same. The widths of the fins 15, however, may vary without departing from the scope of the invention. The fins 15 in each pair are also shown to be co-linear with each other, although there are other possible embodiments that do not exhibit this co-linearity.

Figure 8:
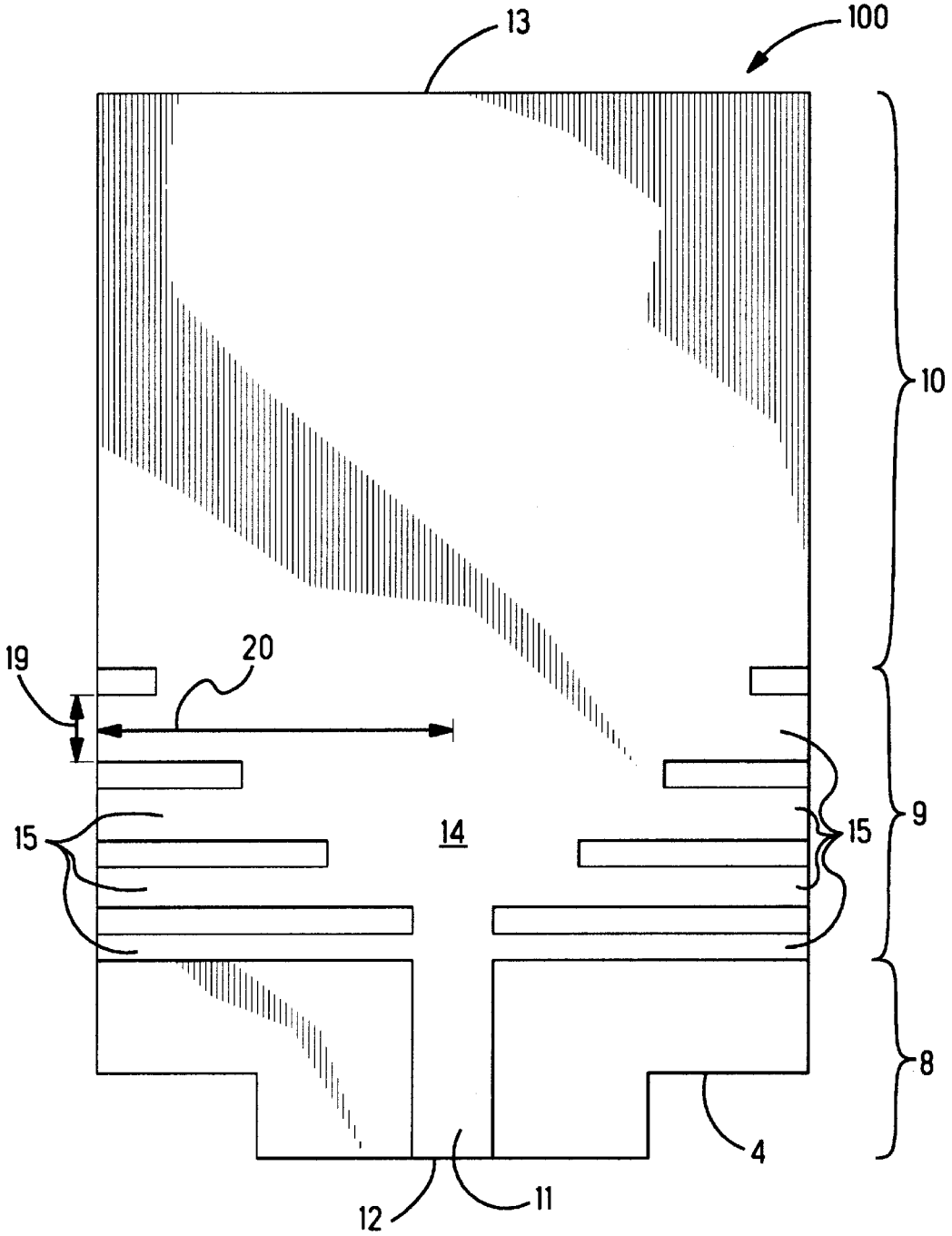
FIG. 8 is a plan view of another alternate embodiment a microstrip mode to rectangular wave mode transformer.

With specific reference to FIG. 8 of the drawings, there is shown another alternate embodiment of a transformer according to the teachings of the present invention in which, the width dimension 19 of each pair of fins 15 is dissimilar from the remaining fins in the conversion portion 9. The width dimension 19 of the pair of fins 15 positioned closest to the quasi-TEM mode portion 8 is smaller than the remaining pairs of fins in the conversion portion 9. In this embodiment, the width dimension 19 of the fins 15 tapers from a narrowest width adjacent the quasi-TEM mode portion 8 to a widest width adjacent the rectangular mode portion 10. As with all of the previously disclosed embodiments, it is not necessary that each fin in the pair be co-linear or of the same length dimension 20, and it is not necessary to have the same number of fins 15 on opposite sides of the conversion trace 14. In addition, the number of fins 15 comprising the conversion portion 9 may vary depending upon the desired characteristics of the design, which may be simulated according to conventional practice.

Figure 9:
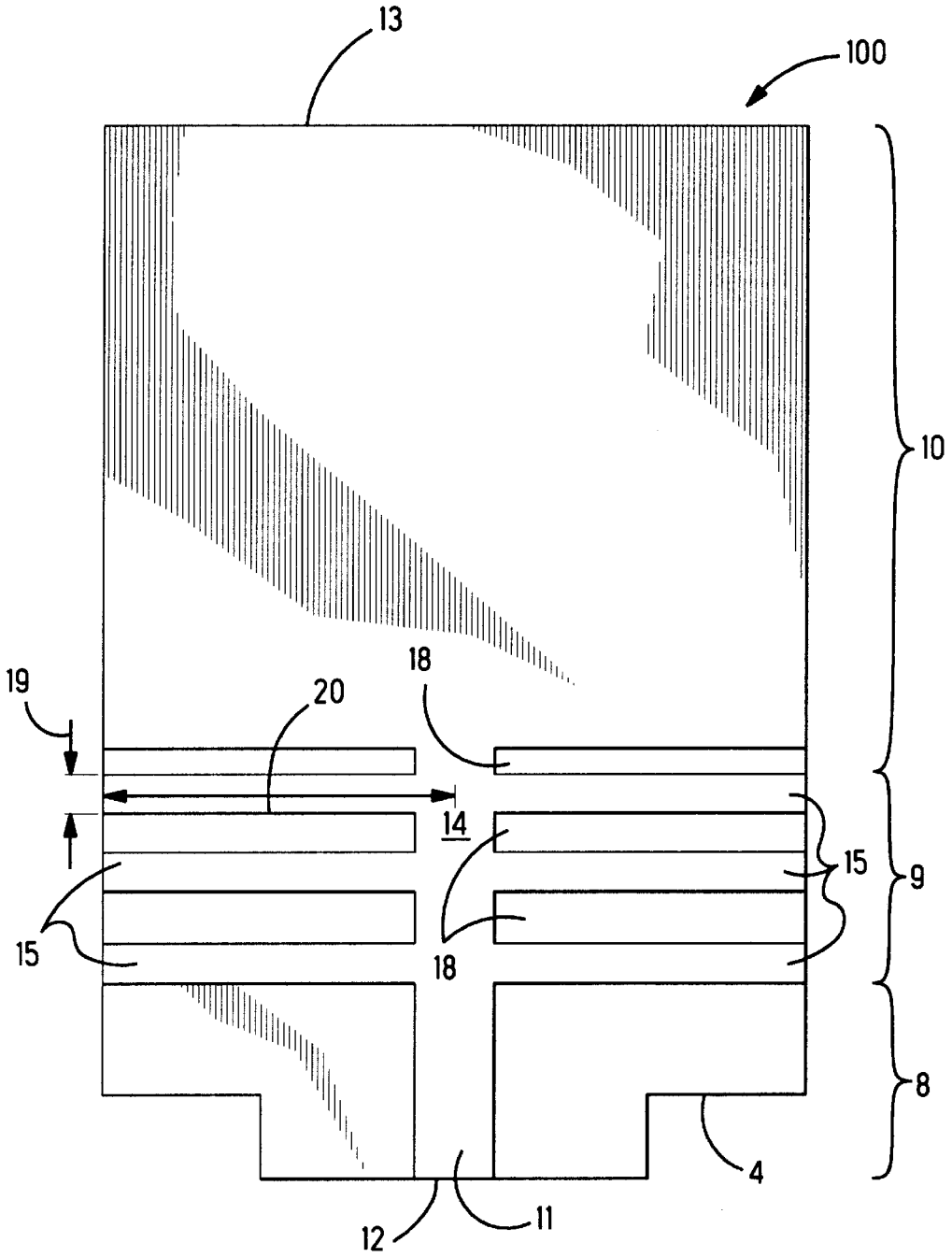
FIG. 9 is a plan view of another alternate embodiment of a microstrip mode to rectangular wave mode transformer.

With specific reference to FIG. 9 of the drawings, there is shown another embodiment of a transformer according to the teachings of the present invention in which there are three pairs of converting fins 15. The width dimension 19 and the length dimension 20 of each fin are the same. A separation distance 18 between fins 15 tapers from a widest separation distance closest to the quasi-TEM mode portion 8 to a narrowest separation distance adjacent the rectangular mode portion 10. In this embodiment, it is unnecessary that the fins 15 in a pair of fins be of the same size or be co-linear with each other. In addition, the number of fins 15 comprising the conversion portion 9 may vary depending upon the desired characteristics of the design, which may be simulated according to conventional practice.

Figure 10:
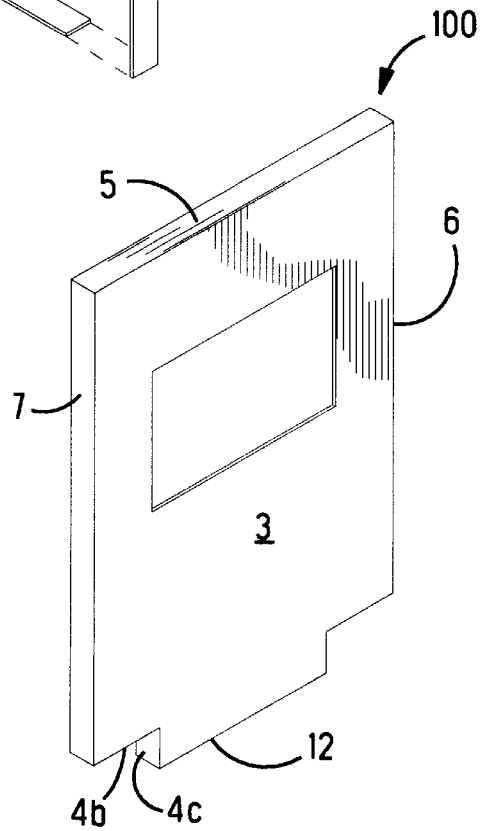
FIG. 10 is a plan view of another alternate embodiment of a microstrip mode to rectangular wave mode transformer that operates to bend the direction of waveguide mode propagation 90 degrees.

With specific reference to FIG. 10 of the drawings, there is shown a transformer according to the teachings of the present invention wherein there is an opening in the metalization on the second major surface 3 adjacent the waveguide portion and the second minor surface 5 is plated creating a back short. In this embodiment, the propagating signal bends 90 degrees to exit the waveguide portion of the transformer and launches into an air medium.

Other advantages of differing embodiments of the invention are apparent from the detailed description by way of example, and from the accompanying drawings, and from the scope of the appended claims.

What is claimed is:

1. A signal line to waveguide transformer optimized for operation at an operating frequency comprising:

a substrate having first and second major surfaces and first, second, third, and fourth minor surfaces, said second major surface having a conductive material thereon electrically connected to reference potential, said third and fourth minor surfaces defining an electrical short on said second major surface, a length of conductive trace for carrying an electrical signal disposed on said first major surface of said substrate, a waveguide integrally formed from at least a portion of said first major surface of said substrate, said waveguide electrically coupled to said conductive trace and defining a direction of signal propagation disposed on said first major surface of said substrate from said conductive trace toward said waveguide, and at least one transmission line disposed on said first major surface of said substrate, electrically connected to said conductive trace, oriented perpendicularly relative to the direction of signal propagation.

2. A signal line to waveguide transformer as recited in claim 1 wherein said at least one transmission line comprises at least one fin.

3. A signal line to waveguide transformer as recited in claim 2 wherein said fin has a length that is greater than or equal to one quarter of a wavelength of the operating frequency.

4. A signal line to waveguide transformer as recited in claim 1 wherein said at least one transmission line further comprises at least one pair of transmission lines disposed on said first major surface of said substrate oriented perpendicularly relative to said direction of signal propagation and on opposite sides of said trace.

5. A signal line to waveguide transformer as recited in claim 4 wherein said at least one pair of transmission lines comprise at least one pair of fins.

6. A signal line to waveguide transformer as recited in claim 5 wherein each fin is the same size.

7. A signal line to waveguide transformer as recited in claim 1 wherein said trace widens in a direction of signal propagation.

8. A signal line to waveguide transformer as recited in claim 5 comprising at least two pairs of fins disposed on said first major surface of said substrate, each fin in said pair of fins on opposite sides of said trace.

9. A signal line to waveguide transformer as recited in claim 8 wherein each fin in one of said pairs is the same size.

10. A signal line to waveguide transformer as recited in claim 8 wherein all fins are the same size.

11. A signal line to waveguide transformer as recited in claim 8 wherein said fins are of differing sizes.

12. A signal line to waveguide transformer as recited in claim 11 wherein a first pair of fins closest to said first minor surface are narrower than a next adjacent pair of fins.

13. A signal line to waveguide transformer as recited in claim 5 wherein each fin in said pair of fins are co-linear with each other.

14. A signal line to waveguide transformer as recited in claim 5 and further comprising at least two pairs of fins, wherein said pairs of fins are disposed equidistant from each other.

15. A signal line to waveguide transformer as recited in claim 5 and further comprising at least two pairs of fins, wherein said pairs of fins are disposed at different distances relative to each other.

16. A signal line to waveguide transformer as recited in claim 15 wherein a distance between said at least two pairs of fins closest to said first minor surface is wider than a distance between a pair of fins furthest from said first minor surface and said waveguide.

17. A signal line to waveguide transformer as recited in claim 2 wherein said fin is oriented on said first major surface a distance from said first minor surface or between approximately one quarter of a wavelength of the operating frequency and one half of a wavelength of the operating frequency.

18. A signal line to waveguide transformer as recited in claim 1 wherein said trace widens in an area juxtaposed to said at least one transmission line.

19. A signal line to waveguide transformer as recited in claim 1 wherein a portion of said first minor surface adjacent said trace on said first major surface is free of metalization.

20. A signal line to waveguide transformer optimized for operation at an operating frequency comprising:

a substrate having first and second major surfaces and first, second, third, and fourth minor surfaces, wherein said third and fourth minor surfaces and said second major surface have a conductive material thereon, a length of conductive trace disposed on said first major surface of said substrate defining a direction of signal propagation, at least one pair of transmission lines disposed on said first major surface of said substrate and oriented perpendicularly relative to said direction of signal propagation, each transmission line positioned on a opposite side of and electrically coupled to said trace, and a waveguide formed from at least a portion of said first major surface of said substrate, said waveguide electrically coupled to said conductive trace.

21. A signal line to rectangular mode transformer as recited in claim 20 wherein said at least one pair of transmission lines comprise at least one pair of fins.

22. A signal line to rectangular mode transformer as recited in claim 21 wherein each fin in said at least one pair of fins has a length that is greater than or equal to one quarter of a wavelength of the operating frequency.

23. A signal line to rectangular mode transformer as recited in claim 21 wherein each fin in said at least one pair of fins is the same size.

24. A signal line to rectangular mode transformer as recited in claim 23 wherein each said fin has a length of approximately one quarter of a wavelength of the operating frequency.

25. A signal line to rectangular mode transformer as recited in claim 24 comprising at least two pairs of fins disposed on said first major surface of said substrate, each fin in said pair of fins oriented perpendicularly relative to said direction of signal propagation and on opposite sides of said trace.

26. A signal line to rectangular mode transformer as recited in claim 24 wherein each fin in each of said pairs is the same size.

27. A signal line to rectangular mode transformer as recited in claim 24 wherein all fins are the same size.

28. A signal line to rectangular mode transformer as recited in claim 24 wherein said pairs of fins have differing sizes.

29. A signal line to rectangular mode transformer as recited in claim 28 wherein a first pair of fins closest to said first minor edge are wider than a next adjacent pair of fins.

30. A signal line to rectangular mode transformer as recited in claim 24 wherein each fin in said at least one pair of fins are co-linear with each other.

31. A signal line to rectangular mode transformer as recited in claim 24 wherein one of said at least one pair of fins is oriented on the first major surface a distance from the first minor surface of between approximately one quarter of a wavelength of the operating frequency and one half of a wavelength of the operating frequency.

32. A signal line to rectangular mode transformer as recited in claim 20 wherein said trace widens in an area juxtaposed to said fins.

33. A signal line to rectangular mode transformer as recited in claim 20 wherein a portion of said first minor surface adjacent said trace on said first major surface is free of metalization.

34. A signal line to rectangular mode transformer as recited in claim 20 wherein said first, second, and third minor surfaces and said second major surface are metalized and are connected to reference potential and said fourth minor surface is not metalized.

35. A signal line to rectangular mode transformer as recited in claim 20 wherein said waveguide comprises metalization on said first major surface between an area defined by said at least one pair of fins and said second minor surface.

36. A signal line to rectangular mode transformer as recited in claim 20 and further comprising at least three pairs of fins, wherein said pairs of fins are disposed equidistant from each other.

37. A signal line to rectangular mode transformer as recited in claim 20 and further comprising at least two pairs of fins, wherein said pairs of fins are disposed at different distances relative to each other and to said waveguide.

38. A signal line to rectangular mode transformer as recited in claim 37 wherein a distance between said pair of fins closest to said first minor surface is wider than a distance between said pair of fins and said waveguide.

* * * * *